United States Patent [19]

Waeber et al.

[11] Patent Number: 4,969,234

[45] Date of Patent: Nov. 13, 1990

[54] METHOD OF REDUCING THE STICKINESS OF COTTON FIBERS

[75] Inventors: Rene Waeber, Winterthur; Robert Demuth, Nuerensdorf; Fritz Knabenhans; Othmar Bachmann, both of Winterthur, all of Switzerland

[73] Assignee: Maschinenfabrik Rieter AG, Winterthur, Switzerland

[21] Appl. No.: 359,494

[22] Filed: May 31, 1989

[30] Foreign Application Priority Data

Jun. 3, 1988 [CH] Switzerland ..... 02120/88

[51] Int. Cl.[5] ..... D01B 3/04; D01D 10/02

[52] U.S. Cl. ..... 19/66 CC; 19/0.27

[58] Field of Search ..... 19/66 CC, 66 R, 200, 19/0.27

[56] References Cited

U.S. PATENT DOCUMENTS

| | | | |
|---|---|---|---|
| 3,676,295 | 7/1972 | Rice | 19/0.27 |
| 4,535,510 | 8/1985 | Shoham | 19/0.27 |
| 4,796,334 | 1/1989 | Yecheskel et al. | 19/0.27 |

FOREIGN PATENT DOCUMENTS

| | | | |
|---|---|---|---|
| 196449 | 8/1986 | European Pat. Off. | 19/0.27 |
| 175338 | 9/1906 | Fed. Rep. of Germany . | |
| 1133286 | 7/1962 | Fed. Rep. of Germany . | |
| 7807694 | 10/1978 | France . | |

*Primary Examiner*—Werner H. Schroeder
*Assistant Examiner*—Michael A. Neas
*Attorney, Agent, or Firm*—Sandler, Greenblum & Bernstein

[57] ABSTRACT

The invention relates to a method of reducing the stickiness or tackiness of cotton flocks. For this purpose, cotton flocks delivered by any suitable conveyor mechanism are received in a flock chute and brought, by rolls or rollers, as a fiber batt between a number of heated rolls or rollers, in order to be heated such that the stickiness or tackiness of the honeydew on the cotton is thus reduced to an extend which no longer has an adverse effect on subsequent machinery. Downstream of the heated rolls or rollers the fiber batt is again opened into cotton flocks by an opening roll or roller and fed to a pneumatic conveyor line through which the cotton flocks are fed to the subsequent machine.

12 Claims, 4 Drawing Sheets

METHOD OF REDUCING THE STICKINESS OF COTTON FIBERS

CROSS-REFERENCE TO RELATED APPLICATIONS AND PATENT

This application is related to copending U.S. application Ser. No. 07/132,790, filed Dec. 10, 1987, entitled "TREATMENT OF COTTON", and which application is a divisional application to U.S. application Ser. No. 06/833,987, filed Feb. 26, 1986, entitled "TREATMENT OF COTTON", now U.S. Pat. No. 4,796,334, granted Jan. 10, 1989, which is related also to copending U.S. application Ser. No. 07/207,252, filed June 15, 1988, entitled "TREATMENT OF COTTON", and which application is a continuation application to the aforementioned parent application, namely U.S. application No. 06/833,987. This application is also related to the commonly assigned U.S. application Ser. No. 07/359,495, filed May 31, 1989, and entitled "METHOD OF AND APPARATUS FOR TREATING COTTON CONTAMINATED WITH HONEYDEW" and also related to the commonly assigned, copending U.S. application Ser. No. 07/363,784 filed June 9, 1989, entitled "METHOD OF AND APPARATUS FOR REDUCING THE STICKINESS OF THE FIBERS OF COTTON FLOCKS CONTAMINATED WITH HONEDEW".

BACKGROUND OF THE INVENTION

The present invention broadly relates to treating contaminated cotton fibers or flocks when such are being continuously processed and, more specifically pertains to a new and improved method of reducing the stickiness or tackiness of the fibers of cotton flocks contaminated with honeydew. The present invention also relates to a new and improved apparatus for reducing the stickiness or tackiness of the fibers of cotton flocks contaminated with honeydew.

Generally speaking, the present invention relates to a new and improved method of the aforementioned type and which method entails heating the cotton flocks for a brief period of time.

It is known that cotton flocks of many provenances or origins are more or less contaminated with insect secretions which contain sugar. These sugar-containing secretions are generally termed "honeydew". There is known a laboratory method by means of which such honeydew is allowed to caramelize by heating cotton flock samples or specimens in an oven with the aim of thereby producing a discoloration or change of color of the cotton, in order to determine the degree of contamination thereof with honeydew from the resulting change in the color of the cotton flocks. This is namely very important because, in the event of heavy contamination of the cotton flocks, the cotton flocks become sticky and tend to adhere to various parts of the yarn production plant or to form laps or coils at rolls or rollers or at other rotatable members. This result is very undesirable since it causes frequent interruptions of the yarn manufacturing process.

A method of the aforementioned type is disclosed in European Patent Application No. 86102352.1, published Oct. 8, 1986, under Publication No. 196,449. The object of this known method is to convert any contaminating honeydew into a non-tacky or non-adhesive and brittle state or condition by supplying heat for a short period of time, but without causing any discoloration or change of color of the cotton flocks, so that the brittle sugar or caramellized deposits can be crushed and removed in the course of the subsequent treatment.

A number of devices or apparatus for performing this prior art method have been proposed in the abovementioned European Patent Application No. 86102352.1, published under Publication No. 196,449. The object of one disclosed device or apparatus is to heat the cotton flocks already in the course of opening the raw cotton bales, i.e. directly at the start of the yarn manufacturing process. Other devices or apparatus are intended for treating fiber slivers before drafting.

SUMMARY OF THE INVENTION

Therefore, with the foregoing in mind it is a primary object of the present invention to provide a new and improved method of reducing the stickiness or tackiness or adhesiveness of the fibers of cotton flocks, which method can be performed or applied at any processing or treatment stage of the cotton flocks, i.e. during ginning and cleaning as well as before carding and drafting.

Another and more specific object of the present invention aims at providing a new and improved method of reducing the stickiness or tackiness of cotton flocks and by means of which a uniform and rapid heat transfer into the fiber batt is attainable and detrimental or undesired effects of uncontrolled heating are obviated.

Now to implement these and still further objects of the invention, which will become more readily apparent as the description proceeds, the method of the present invention of reducing the stickiness or tackiness of the fibers of cotton flocks contaminated with honeydew is manifested, among other things, by the steps of pressing together the cotton flocks to form a fiber batt or web or the like, then guiding such fiber batt over at least three and preferably five rotating heated rolls or rollers and clamping the fiber batt therebetween. The fiber batt is continuously moved and subsequently opened again into fiber flocks, such fiber flocks being transferred to an immediately following unit which conveys or processes the fiber flocks.

As alluded to above, the invention is not only concerned with the aforementioned method aspects, but also relates to a new and improved construction of apparatus for carrying out the inventive method.

To achieve the aforementioned measures, the inventive apparatus, in its more specific aspects, among other things, comprises a fiber feeding device by means of which the fiber flocks are compressed into a fiber batt or web and fed in this condition or form to a plurality of heatable rolls or rollers following thereupon. Downstream of such heatable rolls or rollers, as viewed in the conveying direction of the fiber batt or web, there are provided opening and infeeding means for opening the fiber batt or web again into fiber flocks and infeeding such fiber flocks to fiber conveyor means.

The inventive method of reducing the stickiness or tackiness of cotton flocks and the apparatus constructed according to the invention are based on the finding that the amount of heat that can be applied to or brought into a fiber batt or web at a press nip or clamping location between two heatable rolls or rollers or at locations directly upstream or directly downstream of the press nip or clamping location is far greater than the amount of heat that can be applied to or brought into the very same fiber batt or web, when the latter simply embraces or wraps around a heated roll or roller.

This is due not only to the fact that the fiber batt or web in the press nip or clamping location is heated from both sides, but rather also due to the fact that the conductivity of the fiber batt or web in the compressed state is higher, by virtue of the reduction of the amount of air contained in the fiber batt or web, than in a fiber batt or web which is only wrapped around a heated roll or roller and thus freely exposed on one side.

According to the invention, the best results are obtained when cotton in the press nip or clamping location of the rolls or rollers is compressed to a density of 100 to 400 kg/m$^3$, preferably about 250 kg/m$^3$.

A particularly preferred variant of the method according to the invention comprises the steps of applying at least one belt or band which revolves around at least two rotating heated rolls or rollers, providing at least one further rotating heated roll or roller forming press nip or clamping locations with the at least two rotating heated rolls or rollers, and clamping the fiber batt or web against the at least one further rotating heated roll over a part of the surface thereof. The resulting improvement in heat transfer is due to the fact that the length of the press nip or clamping location is artificially extended or enlarged by the revolving belt or band.

A further particularly preferred variant of the method according to the invention comprises the step of at least partially exposing or laying bare at least one surface of the fiber batt or web, preferably the upper or top surface thereof, to allow water vapor to escape during the heating operation. If this step is omitted and no provision is made for the vapors generated during the heating process to escape, there is the risk of the cotton flocks remaining sticky or tacky even after the heat treatment has been effected.

In a preferred embodiment of the apparatus constructed according to the invention for reducing the stickiness or tackiness of the fibers of cotton flocks, the plurality of heatable rolls or rollers are arranged in a preferably ascending chimney or flue through which an air current or flow is effected by means of a blower or fan. In this manner, any generated vapors are sucked out or blown away.

The chimney is preferably located between a flock feed chute and an opening roll or roller which opens the fiber batt or web into fiber flocks. Such an arrangement renders possible the space-saving and economical integration of the inventive apparatus in an existing feeder of a card or carding machine.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
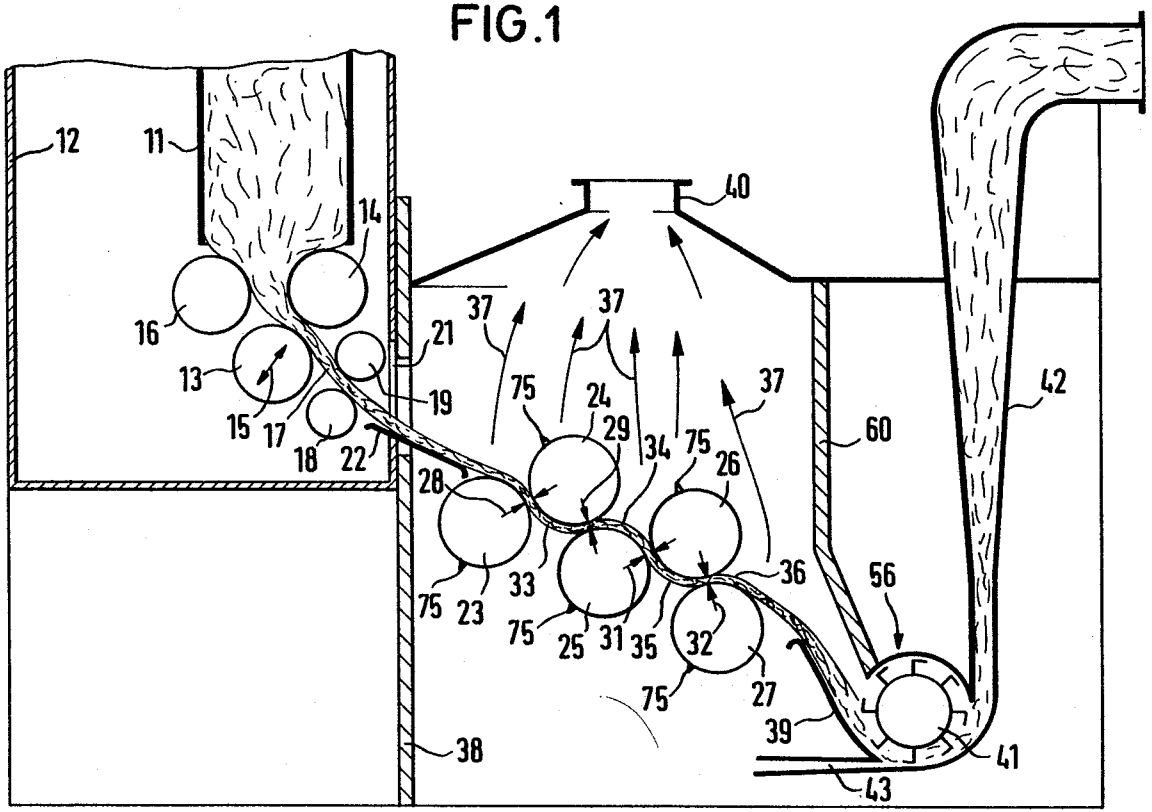
FIG. 1 shows a schematic side view of an exemplary embodiment of the inventive apparatus for reducing the stickiness or tackiness of cotton flocks.

Describing now the drawings, it is to be understood that to simplify the showing thereof, only enough of the structure of the apparatus for realizing the inventive method of reducing the stickiness or tackiness of the fibers of cotton flocks contaminated with honeydew or the like has been illustrated therein as is needed to enable one skilled in the art to readily understand the underlying principles and concepts of the present invention. Turning attention now specifically to FIG. 1 of the drawings, the apparatus illustrated therein by way of example and not limitation will be seen to comprise a lower or bottom part of a flock chute or shaft 11 such as is normally used upstream of a card or carding machine. At the lower end of this flock chute or shaft 11, which is disposed in a flock chute housing 12, there are arranged two take-up or delivery rolls or rollers 13 and 14. While the axis of rotation of the take-up or delivery roll or roller 14 is fixedly arranged in space, the axis of rotation of the other take-up or delivery roll or roller 13 is displaceable in the direction of the double-headed arrow 15, in order to adjust the desired thickness of a fiber feed or fiber batt.

A further rotatable roll or roller 16 is provided upstream of the take-up or delivery roll or roller 13 and is arranged in spaced relationship with respect to the take-up or delivery roll or roller 14. This further rotatable roll or roller 16 performs a guide function for the cotton flocks in the flock chute or shaft 11. A fiber batt or web 17 produced by the take-up or delivery rolls or rollers 13 and 14 is conducted, instantly downstream of the take-up or delivery rolls 13 and 14, between clamping means and a counter element here shown as two clamping rolls 18 and 19 which serve to clamp the fiber batt or web 17 in the event of any interruption or stoppage of the manufacturing process and thus prevent any further conveyance of cotton flocks. The take-up or delivery rolls 13 and 14 are stopped during this operation.

In normal operation, the fiber batt or web 17 then passes on through an exit slot or opening 21 located at the bottom end of the flock chute housing 12 and over a guide plate 22 to an arrangement or array of heatable rolls or rollers. This heatable roll arrangement or array here comprises, for instance, five individual heatable rolls or rollers 23, 24, 25, 26 and 27 which are alternately arranged in a downwardly inclined row on both sides of the fiber batt or web 17. All five heatable rolls or rollers 23 through 27 are driven so that the fiber batt or web 17 is drawn or pulled through the rolls or rollers 23 through 27.

As will be apparent from FIG. 1, four press nip or clamping locations 28, 29, 31 and 32 are provided between the five heatable rolls or rollers 23 through 27. These four press nip or clamping locations 28, 29, 31 and 32 preferably have a press nip or clamping width of 4 mm or less. Before entering the press nip or clamping location 28, the fiber batt or web 17 on the guide plate 22 has a thickness of about 100 mm. Therefore, the fiber or flock batt or web 17 undergoes a 20 to 25 times compression in the press nip.

Between the heatable rolls or rollers 23 through 27 and downstream of the heatable roll or roller 27 there are free or exposed regions or areas 33, 34, 35 and 36 of the fiber batt or web 17 where the vapors produced by the heating operation can escape. This can be assisted by an air current or flow 37 produced by a suitable blower or fan which is not particularly shown in the drawing, but which could be, for instance, flanged at a pipe connection or spigot 40. This pipe connection or spigot 40 is located at the top or upper end of a chimney or flue 38 in which the heatable roll or roller arrangement or array is accommodated. This chimney 38 vertically extends or ascends between the flock chute or shaft 11 and a feeding device or system for a card or carding machine.

After leaving the last heatable roll or roller 27, the compressed and heated fiber batt or web 17 passes over a guide plate 39 to an opening roll or roller 41 of an infeeding or infeed device 56. Here, the fiber batt or web 17 is again opened into individual cotton flocks, which are blown or sucked into a rising or ascending line or conduit 42 which finally leads to a subsequent machine in the ginning process or in the cleaning department of the spinning mill. A line or conduit 43 serves to admit or allow for the ingress of an air current or flow substantially tangentially in the direction of movement of the opening roll or roller 41, in order to promote the pneumatic conveyance or transport of the loosened cotton flocks in a line or conduit 42. The opening roll or roller 41 is located at the lower or bottom end of a separating or partition wall 60 which forms a lateral or side wall of the chimney 38.

Figure 2:
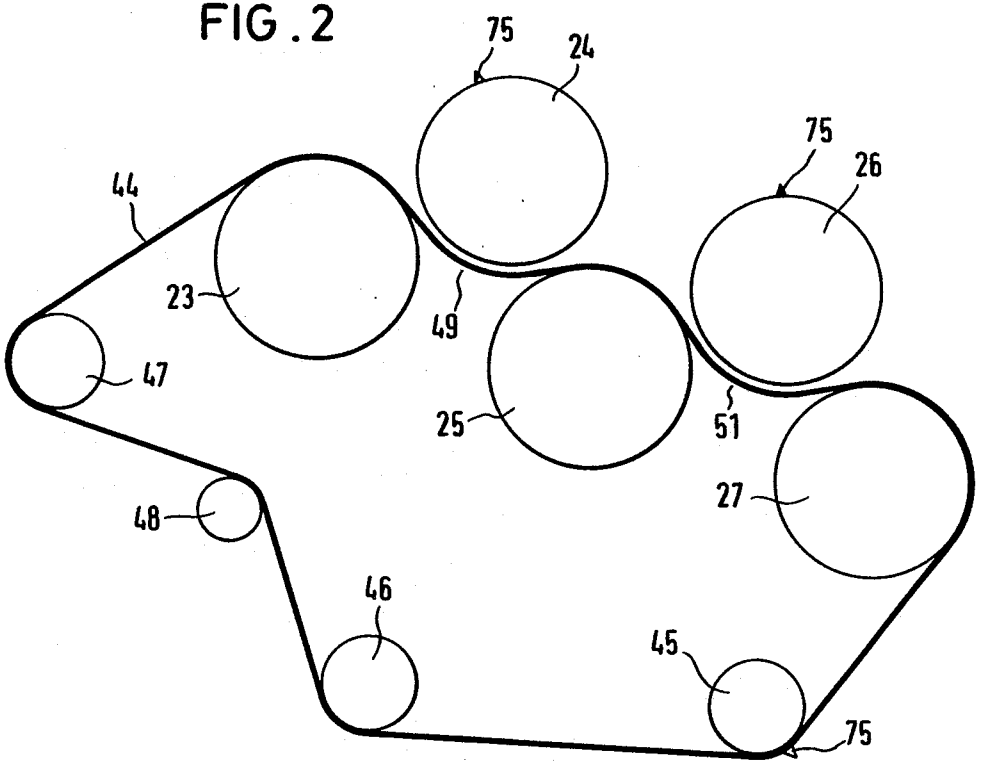
FIG. 2 schematically shows a side view of a modified embodiment of the heatable rolls or rollers of the apparatus illustrated in FIG. 1.

FIG. 2 shows a modified embodiment of the heatable roll or roller arrangement or array of FIG. 1 in which a revolving belt or band 44 wraps around the three heatable rolls or rollers 23, 25 and 27 arranged below the fiber batt or web 17. This revolving belt or band 44 is driven at the same speed as the circumferential speed of the heatable rolls or rollers 23 through 27, either by the heatable rolls or rollers 23 through 27 themselves or by a driven deflection roll or roller 45. Two further deflection rolls or rollers 46 and 47 as well as a tension roll or roller 48 provide uniform movement or travel of the revolving belt or band 44 and the desired or required tension of such revolving belt or band 44. Extended press nip or clamping locations or zones 49 and 51 between the revolving belt or band 44 and the top or upper heatable rolls or rollers 24 and 26, respectively, are formed by the revolving belt or band 44.

In this embodiment, the tension of the revolving belt or band 44 is selected such that the fiber batt or web 17 in the press nip locations or clamping locations or zones 49 and 51 has a thickness of about 4 mm or less. The revolving belt or band 44 is preferably made of metal and is itself heated by the heatable rolls or rollers 23, 25 and 27 so that the heat input or transfer into the fiber batt or web 17 is accomplished from both sides.

Figure 3:
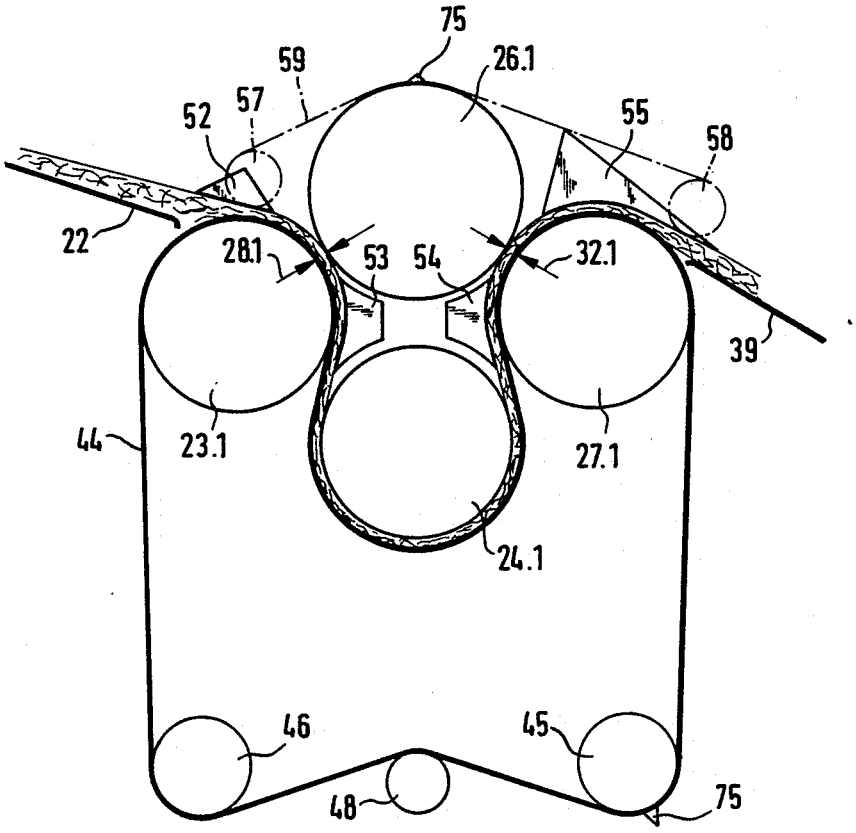
FIG. 3 schematically shows a side view of a further embodiment of heatable rolls or rollers which can be used instead of the heatable rolls or rollers in the exemplary embodiment of the inventive apparatus illustrated in FIGS. 1 and 2.

FIG. 3 shows a further possibility of heating a fiber batt or web 17 in the clamped condition or state thereof. Four rotating heatable rolls or rollers 23.1, 24.1, 27.1 and 26.1 are provided. The revolving belt or band 44 passes over the first rotating heatable roll or roller 23.1, beneath the second rotating heatable roll or roller 24.1, over the third rotating heatable roll or roller 27.1 and then over two deflection rolls or rollers 45 and 46. Also in this case, there is provided a tension roll or roller 48. Above the second rotating heatable roll or roller 24.1 there is located the fourth rotating heatable roll or roller 26.1 which forms two press nip or clamping locations 28.1 and 32.1 with the surfaces of the two lower rotating heatable rolls or rollers 23.1 and 27.1 or with the surface of the revolving belt or band 44 wrapped around these two lower rotating heatable rolls or rollers 23.1 and 27.1, respectively. The fiber batt or web 17 runs over the guide plate 22, beneath a stationary guide or guide member 52 and through the press nip or clamping location 28.1, then along a further stationary guide or guide member 53, over the surface of the rotating heatable roll or roller 24.1 while being clamped by the revolving belt or band 44, past a stationary guide or guide element 54, through the press nip or clamping location 32.1 and finally beneath a further stationary guide or guide member 55 to the guide plate 39. The heated fiber batt or web 17 then passes to the opening roll or roller 41.

In this embodiment, the fiber batt or web 17 is heated over a considerable length in the clamped state or condition by means of just four rotating heatable rolls or rollers. The stationary guides or guide members 52 and 55 can also be replaced by rotatable guide rolls or rollers 57 and 58 or by a further revolving belt or band 59 which is guided or trained around the corresponding heatable rolls or rollers and guide rolls or rollers 57, 23.1, 24.1, 27.1, 58 and 26.1. The guide roll or roller 57 or the guide roll or roller 58 can be provided as a tension roll or roller.

It should be mentioned that the described apparatus or installations use heatable rolls which are heated to a temperature of about 220° C. Heating can be accomplished by means of oil, steam, electric current or any other heat source capable of supplying the required amount of heat in the required time. The fiber batt or web 17 moves through the plant or installation at a speed of between 0.02 m/sec and 0.1 m/sec. If the cotton being processed is not contaminated with honeydew, the heating can be simply turned off or the entire plant or installation can be by-passed.

Figure 4:
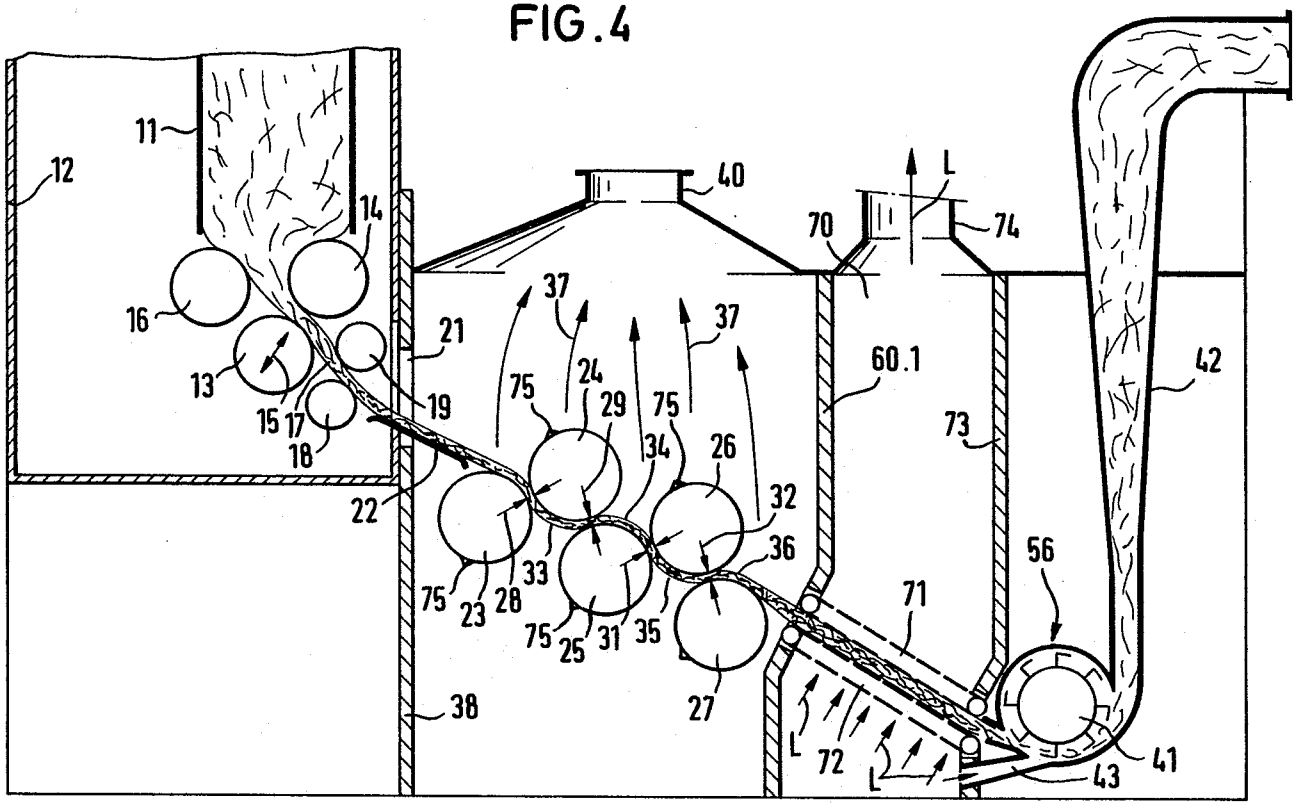
FIG. 4 schematically shows a variant of the apparatus illustrated in FIG. 1.

FIG. 4 shows a variant of the apparatus of FIG. 1 inasmuch as a cooling zone or area 70 is provided between the chimney or flue 38 and the infeeding device 56, in order to cool the heated fiber batt or web 17 between two cooling conveyor belts or bands 71 and 72.

The cooling zone or area 70 is separated, by a separating or partition wall 60.1 and by a separating or partition wall 73 arranged opposite thereto, from the chimney 38 and from the region or area containing the infeeding device 56. The separating or partition walls 60.1 and 73 shown in FIG. 4 are of course closed by two end sides or walls to form a closed room or space.

On the other hand, these end sides or walls not particularly designated by reference characters in the drawing of FIG. 4 are provided with air inlet openings (not shown) to admit an air flow or current L which, for the purpose of cooling the fiber batt or web 17 located between the two cooling conveyor belts or bands 71 and 72, flows, for instance, substantially perpendicular through these two cooling conveyor belts or bands 71 and 72 which consist of lattice work or mesh structure. The air flow or current L is generated by a suitable suction fan (not shown), which is connected to a connection pipe or spigot or stud 74. The airflow or current L should have a relative air humidity which is able to absorb humidity from the fiber flocks.

The cooling conveyor belts or bands 71 and 72 are synchronously driven by a suitable single drive not particularly shown in the drawing of FIG. 4 and convey the fiber batt or web 17 at the outlet speed thereof prevailing in the press nip or clamping location 32 between the two last heated rolls or rollers 26 and 27.

It is readily conceivable that the fiber flocks can also be cooled in the next following unit for conveying or otherwise acting upon the fiber flocks, such unit being arranged downstream of the opening roll 56.

Finally, reference is made to the stripping or stripper knives 75 which are provided at the rolls or rollers or at the conveyor belts or bands for the purpose of removing or picking up any honeydew deposits. These stripping or stripper knives 75 can also be heated to effect a caramelization of the honeydew adhering thereto.

While there are shown and described present preferred embodiments of the invention, it is to be distinctly understood that the invention is not limited thereto, but may be otherwise variously embodied and practiced within the scope of the following claims. Accordingly,

What we claim is:

1. A method of reducing the stickiness of fibers of cotton flocks which are contaminated with honeydew, by heating the contaminated cotton flocks for a brief period of time, comprising the steps of:

compressing the cotton flocks to form a fiber batt;

guiding said fiber batt through an arrangement of at least three rotating heated rolls which clamp said fiber batt therebetween and continuously move said fiber batt;

heating said fiber batt during said step of guiding said fiber batt through an arrangement of said at least three rotating heated rolls;

opening said fiber batt again into fiber flocks;

transferring said fiber flocks to a next following unit for acting upon said fiber flocks;

applying at least one revolving belt to revolve around said at least three rotating heated rolls;

arranging at least one further heated roll for forming press nip locations with at least preselected ones of said at least three rotating heated rolls; and using said revolving belt for clamping said fiber batt against said at least one further heated roll over a part of the surface thereof.

2. The method as defined in claim 3, wherein:

said step of guiding said fiber batt through an arrangement of at least three rotating heated rolls entails providing five rotating heated rolls through which there is guided the fiber batt.

3. The method as defined in claim 1, further including the step of:

exposing at least partially at least one surface of said fiber batt for allowing water vapor to escape during said step of guiding said fiber batt.

4. The method as defined in claim 1, further including the step of:

exposing at least partially an upper surface of said fiber batt for allowing water vapor to escape therefrom during said step of guiding said fiber batt.

5. The method as defined in claim 1, further including the step of:

cooling said fiber flocks of said fiber batt after said step of heating said fiber batt.

6. The method as defined in claim 5, wherein:

said step of cooling said fiber flocks after said step of heating said fiber batt entails the use of an air current.

7. The method as defined in claim 6, wherein:

said step of cooling said fiber flocks after said step of heating said fiber batt entails the use of an air current having a relative air humidity which is able to absorb humidity from said fiber flocks.

8. The method as defined in claim 1, further including the step of:

cooling said fiber flocks before said step of transferring said fiber flocks to a next following unit for acting upon said fiber flocks.

9. The method as defined in claim 8, wherein:

said step of cooling said fiber flocks before said step of transferring said fiber flocks to a next following unit for acting upon said fiber flocks entails the use of an air current.

10. The method as defined in claim 8, wherein:

said step of cooling said fiber flocks before said step of transferring said fiber flocks to a next following unit for acting upon said fiber flocks entails conveying said fiber flocks as a layer and cooling said fiber flocks by means of an air current flowing substantially perpendicular through said layer.

11. The method as defined in claim 8, wherein:

said step of cooling said fiber flocks before said step of transferring said fiber flocks to a next following unit for acting upon said fiber flocks entails the use of an air current having a relative air humidity which is able to absorb humidity from said fiber flocks.

12. A method of reducing the stickiness of fibers of cotton flocks which are contaminated with honeydew, by heating the contaminated cotton flocks for a brief period of time, comprising the steps of:

compressing the cotton flocks to form a fiber batt;

guiding said fiber batt through an arrangement of at least three rotating heated rolls which clamp said fiber batt therebetween and continuously move said fiber batt;

heating said fiber batt during said step of guiding said fiber batt through an arrangement of said at least three rotating heated rolls;

opening said fiber batt again into fiber flocks;

transferring said fiber flocks to a next following unit for acting upon said fiber flocks; and cooling said fiber flocks in said next following unit for acting upon said fiber flocks.

* * * * *